US006438959B1

(12) United States Patent
Dean et al.

(10) Patent No.: US 6,438,959 B1
(45) Date of Patent: Aug. 27, 2002

(54) COMBUSTION CAP WITH INTEGRAL AIR DIFFUSER AND RELATED METHOD

(75) Inventors: Anthony John Dean, Scotia; Christopher Nelson Chandler, Delmar; Richard Scott Bourgeois, Albany, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/759,194

(22) Filed: Dec. 28, 2000

(51) Int. Cl.[7] ..... F02C 3/14
(52) U.S. Cl. ..... 60/760
(58) Field of Search ..... 60/748, 751, 760, 60/39.02

(56) References Cited

U.S. PATENT DOCUMENTS 3,751,911 A * 8/1973 De Tartaglia ..... 60/760
4,292,801 A 10/1981 Wilkes et al.
4,982,570 A 1/1991 Waslo et al.
5,274,991 A 1/1994 Fitts
5,388,412 A * 2/1995 Werning et al. ..... 60/760
5,557,918 A * 9/1996 Chyou et al. ..... 60/760
6,134,877 A * 10/2000 Alkabie ..... 60/760

* cited by examiner

*Primary Examiner*—Michael Koczo
(74) *Attorney, Agent, or Firm*—Nixon & Vanderhye P.C.

(57) ABSTRACT

A combustion cap assembly for closing a forward end of a combustion chamber includes a radially inner substantially cylindrical component; a radially outer substantially conical component, extending substantially along an entire length dimension of the radially inner component; and an annular airflow passage therebetween. The invention also provides a method for reducing pressure loss across a combustion liner cap assembly located in a gas turbine combustor, the cap assembly supporting a plurality of premix tubes adapted to receive portions of a like number of nozzles, and wherein air flows in an annular passage radially outwardly of the combustor where it reverses direction to flow through the premix tubes, the method including adding a diffuser to the forward end of the cap assembly, the diffuser configured to increase the cross sectional area of the annular flow passage along an axial length of the cap assembly to thereby cause a reduction in velocity of the air in the annular flow passage and thereby reduce pressure loss as the air reverses direction at a forward end of the combustor.

8 Claims, 4 Drawing Sheets

COMBUSTION CAP WITH INTEGRAL AIR DIFFUSER AND RELATED METHOD

This invention relates generally to gas turbine machines and specifically, to a combustion cap assembly for a multi-nozzle, can-annular combustor.

BACKGROUND OF THE INVENTION

Gas turbines generally include a compressor, one or more combustors, a fuel injection system and a turbine. Typically, the compressor pressurizes inlet air which is then turned in direction or reverse flowed to the combustors where it is used to cool the combustor and also to provide air to the combustion process. In a multi-combustor turbine, the combustors are located about the periphery of the gas turbine, and a transition duct connects the outlet end of each combustor with the inlet end of the turbine to deliver the hot products of the combustion process to the turbine.

Generally, in Dry Low NOx combustion systems utilized by the assignee, each combustor includes multiple fuel nozzles, each nozzle having a surrounding dedicated premix section or tube so that, in a premix mode, fuel is premixed with air prior to burning in the single combustion chamber. In this way, the multiple dedicated premixing sections or tubes allow thorough premixing of fuel and air prior to burning, which ultimately results in low NOx levels. See, for example, commonly owned U.S. Pat, No. 5,274,991.

More specifically, each combustor includes a generally cylindrical casing having a longitudinal axis, the casing having fore and aft sections secured to each other, and the casing as a whole secured to the turbine casing. Each combustor also includes an internal flow sleeve, and a combustion liner substantially concentrically arranged within the flow sleeve. Both the flow sleeve and combustion liner extend between the transition duct at their downstream ends, and a combustion liner cap assembly (located within an upstream portion of the combustor) at their upstream ends. The flow sleeve is attached directly to the combustor casing, while the liner supports the liner cap assembly which, in turn, is fixed to the combustor casing. The outer wall of the transition duct and at least a portion of the flow sleeve are provided with air supply holes over a substantial portion of their respective surfaces, thereby permitting compressor air to enter the radial space between the combustion liner and the flow sleeve, and to be reverse flowed to the upstream portion of the combustor.

A plurality (five in the exemplary embodiment) of diffusion/premix fuel nozzles are arranged in a circular array about the longitudinal axis of the combustor casing. These nozzles are mounted in a combustor end cover assembly which closes off the rearward end of the combustor. Inside the combustor, the fuel nozzles extend into and through the combustion liner cap assembly and, specifically, into corresponding ones of the premix tubes that are secured in the liner cap assembly. The discharge end of each nozzle terminates within a corresponding premix tube, in relatively close proximity to the downstream end of the premix tube which opens to the burning zone in the combustion liner.

Spacers between the cap's inner body and its outer mounting flange create an annular passage for premixer air from the compressor. The premixer air travels through this annular passage, then again reverses direction within the combustor's forward case before mixing with gaseous fuel in the inner body of the liner cap assembly, and proceeding to the reaction zone. This air flow reversal (commonly referred to as the "cap turn") results in a pressure loss, which can be as high as 7% of the total combustor pressure drop. The cap turn pressure loss is a result of two effects: (1) expansion of premixer air into the forward case area after passing the cap, and (2) reversal of flow direction within the forward case to travel through the cap burner tubes.

Pressure loss in the combustor is a critical contributor to overall gas turbine performance. Any air the combustion system uses for cooling or loses to leakage is counted against the budgeted overall combustion system pressure drop.

Previous combustor designs have implemented tapered flanges on the cap assembly to allow some degree of flow expansion prior to the cap turn. However, the amount of flow expansion was relatively small, as the diffuser section was only as long as the cap mounting flange.

BRIEF SUMMARY OF THE INVENTION

In this invention, the forward portion of the combustion liner cap assembly is designed as an axial diffuser to reduce the pressure drop caused by the cap turn as the premixer air passes between inner and outer bodies or components of the liner cap assembly and turns toward the fuel nozzles and the combustor chamber.

More specifically, this invention provides a combustion liner cap assembly with a conical outer body that serves to increase the cross-sectional area of the annular passage between a cylindrical inner body and the conical outer body in the direction of airflow, causing a reduction in the velocity of the premixer air as it passes through the cap assembly. These cap assembly modifications, in turn, require an enlarged forward case to accommodate the cap diffuser.

As mentioned above, the cap turn pressure loss is due to expansion of premixer air and the reversal of flow at the forward case. Since the magnitude of the pressure losses is proportional to the square of the air velocity, the reduction of air velocity caused by the axial diffuser results in a lower cap turn pressure loss. In addition, the diffuser improves flow uniformity into the premixers because the flow begins turning from the forward end of the diffuser inner cylinder rather than at the inlets to the premixer tubes. Another expected benefit of this concept is improved flame holding.

Accordingly, this invention relates to a combustion cap assembly for closing a forward end of a combustion chamber comprising a radially inner substantially cylindrical component; a radially outer substantially conical component, extending substantially along an entire length dimension of the radially inner component; and an annular airflow passage therebetween.

The invention also relates to a combustion cap assembly for rlosing a forward end of a combustion chamber comprising a radially inner substantially cylindrical component; a radially outer substantially conical component, extending substantially along an entire length dimension of the radially inner component; and an annular airflow passage therebetween; wherein the annular airflow passage increases in cross sectional area in a flow direction; and further comprising a plate supporting a plurality of premix burner tubes radially inward of said radially inner cylindrical component.

The invention also relates to a method of reducing pressure loss across a combustion liner cap assembly located on a gas turbine combustor, the cap assembly supporting a plurality of premix tubes adapted to enclose portions of a like number of nozzles, and wherein air flows in an annular passage radially outwardly of the combustor where it reverses direction to flow through the premix tubes, the method comprising adding a diffuser to the forward end of the cap assembly, the diffuser configured to increase the cross sectional area of the annular flow passage along an axial length of the cap assembly to thereby cause a reduction in velocity of the air in the annular flow passage and thereby reduce pressure loss as the air reverses direction at the forward end of the combustor.

DETAILED DESCRIPTION OF THE INVENTION

Figure 1:
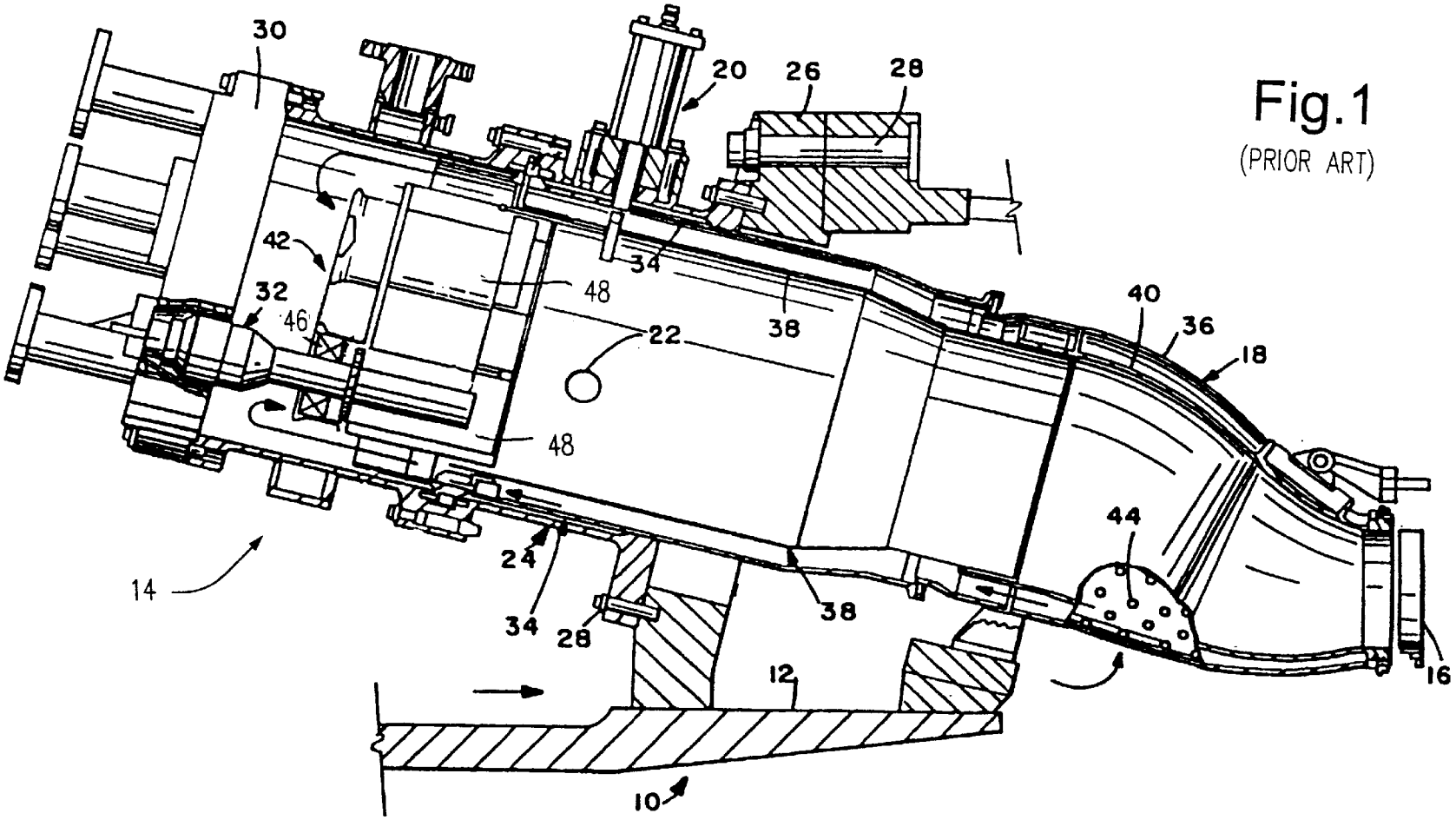
Fig. 1 (PRIOR ART)
FIG. 1 is a partial cross section of a known gas turbine combustor.

With reference to FIG. 1, a conventional gas turbine 10 includes a compressor 12 (partially shown), a plurality of combustors 14 (one shown), and a turbine represented here by a single blade 16. Although not specifically shown, the turbine is drivingly connected to the compressor 12 along a common axis. The compressor 12 pressurizes inlet air which is then reverse flowed to the combustor 14 where it is used to cool the combustor and to provide air to the combustion process.

As noted above, the gas turbine includes a plurality of combustors 14 located about the periphery of the gas turbine. A double-walled transition duct 18 connects the outlet end of each combustor with the inlet end of the turbine to deliver the hot products of combustion (i.e., combustion gases) to the turbine. Ignition is achieved in the combustors by means of a spark plug 20 in conjunction with crossfire tubes (represented by aperture 22) that transfer the flame to adjacent combustors in conventional fashion.

Each combustor 14 includes a substantially cylindrical combustor casing 24 which is secured at an open aft end to the turbine casing 26 by means of bolts 28. The forward end of the combustor casing is closed by an end cover assembly 30 which may include conventional supply tubes, manifolds and associated valves, etc. for feeding gas, liquid fuel and air (and water if desired) to the combustor. The end cover assembly 30 receives a plurality (for example, five) fuel nozzle assemblies 32 (only one shown for purposes of convenience and clarity) arranged in a circular array about a longitudinal axis of the combustor.

Within the combustor casing 24, there is mounted, in substantially concentric relation thereto, a substantially cylindrical flow sleeve 34 that connects at its aft end to the outer wall 36 of the double walled transition duct 18. The flow sleeve 34 is connected at its forward end to the combustor casing 24 at a butt joint where fore and aft sections of the combustor casing are joined.

Within the flow sleeve 34, there is a concentrically arranged combustion liner 38 that is connected at its aft end with the inner wall 40 of the transition duct 18. The forward end of the combustion liner is supported by a combustion liner cap assembly 42 secured to the combustor casing. It will be appreciated that the outer wall 36 of the transition duct 18, as well as a portion of flow sleeve 34 are formed with an array of apertures 44 over their respective peripheral surfaces to permit air to reverse flow from the compressor 12 through the apertures 44 into the annular (radial) space between the flow sleeve 34 and the liner 36 toward the upstream or forward end of the combustor (as indicated by the flow arrows shown in FIG. 1).

At the forward end of the cap assembly 42, the air reverses direction again, flowing through swirlers 46 surrounding each nozzle, and into pre-mix tubes 48 that are also supported by the liner cap assembly, as explained in greater detail in the '991 patent. Note that the nozzles extend into the pre-mix tubes.

Figure 2:
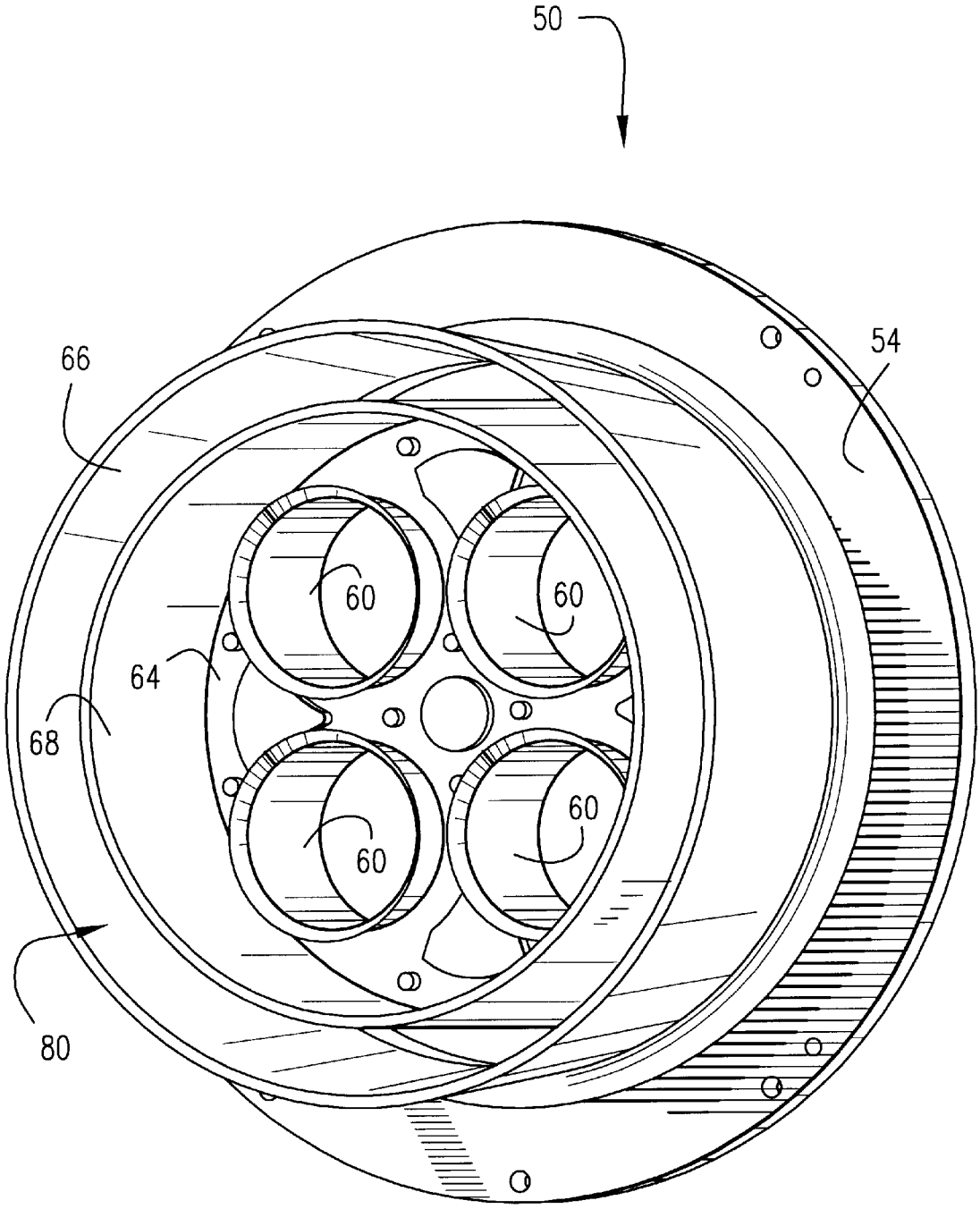
FIG. 2 is a perspective view of a combustion liner cap assembly in accordance with the invention.
Figure 3:
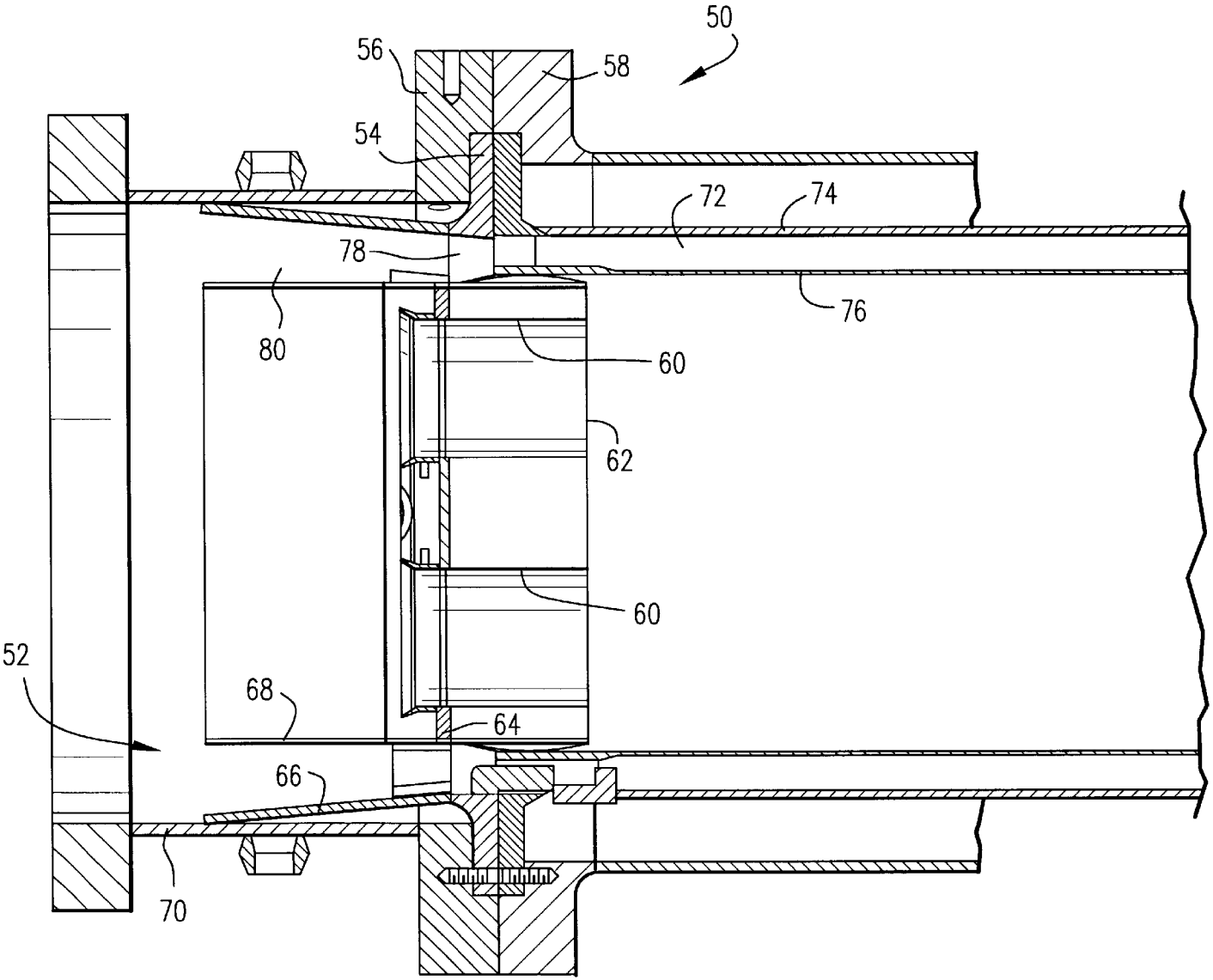
FIG. 3 is a cross section of the combustion liner cap assembly shown in FIG. 2.
Figure 4:
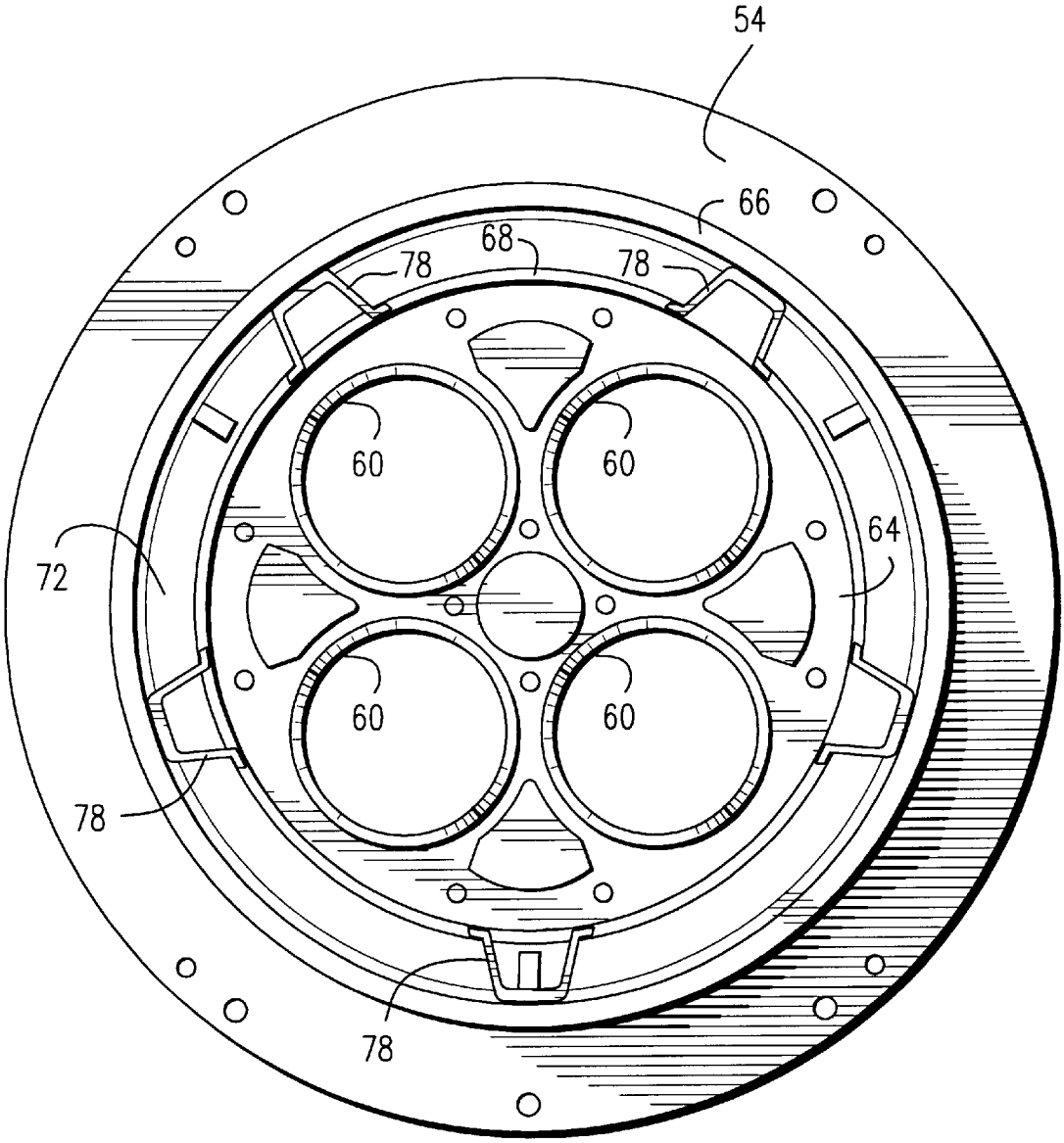
FIG. 4 is an upstream end view of the liner cap assembly shown in FIG. 2.

With reference now to FIGS. 2–4, a new combustion liner cap assembly 50 in accordance with this invention is illustrated. More specifically, the invention relates to the incorporation of an extended axial diffuser 52 in the combustion liner cap assembly 50. The cap assembly 50 includes a radial flange 54 by which the cap assembly is secured between forward and aft turbine combustor casing components 56, 58, utilizing bolts and locating pins in conventional fashion. The cap assembly 50 includes a plurality of pre-mix burner tubes 60 as in the prior construction, with an effusion plate 62 at the aft end thereof. The pre-mix burner tubes are themselves mounted in a circular plate 64.

The axial diffuser 52 of the cap assembly 50 is comprised of three distinct elements: (1) a conical outer body or component 66 that forms the outer radial surface of the extended cap axial diffuser, (2) a cylindrical inner body or component 68 that forms the inner radial surface of the extended cap axial diffuser; and (3) an enlarged cylindrical portion 70 of the forward combustor casing component 56 to accommodate and house the cap diffuser. In this regard, note the forward end of the outer body 66 engages the cylindrical portion 70 of the forward combustor casing component 56.

Air flows in the annular flow passage 72 between the flow sleeve 74 and combustion liner 76, and that radial space is maintained between the diffuser inner body 68 and outer body 66 by means of spacers or webs 78 (best seen in FIG. 4). Because the cross-sectional area of the annular passage 72 between the inner body 68 and outer body 66 increases in the direction of airflow in the expanding region 80 of the flow passage, the velocity of the air decreases as it passes the cap assembly and turns at the forward end of the combustor into the inner body 68, and subsequently into the premix burner tubes 60.

The novel features of this design are the deliberate incorporation of an extended axial diffuser section 52 into the cap assembly 50. The full axial diffuser allows considerable reduction in air velocities that reduce pressure losses. In addition, the diffuser inner cylinder is key to the diffuser concept and contributes improved flameholding margin by making flow into each premixer more uniform.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor and a combustion liner cap assembly comprising:

a combustor having a combustor casing and a combustion liner within said combustor casing and closed at a forward end by the combustion liner cap assembly, said combustion liner cap assembly comprising a radially inner substantially cylindrical component;

a radially outer substantially conical component attached to a forward end of said combustor casing and extending substantially along an entire length dimension of said radially inner component; and an annular airflow passage therebetween; said radially inner substantially cylindrical component and said radially outer substantially conical component located at the forward end of the combustor and wherein said annular airflow passage increases in cross sectional area in a flow direction of air supplied to the combustor that is opposite a flow direction of combustion gases in the combustor.

2. The combustor and combustion liner cap assembly of claim 1 wherein said radially inner component and said radially outer component are separated by a plurality of circumferentially spaced webs.

3. The combustor and combustion liner cap assembly of claim 1 and further comprising a plate supporting a plurality of premix burner tubes radially inward of said radially inner component.

4. The combustor and combustion liner cap assembly of claim 1 including a radial flange on the radially outer substantially conical component, adapted for securing the combustion liner cap assembly between forward and aft turbine combustor casing components.

5. A combustor and a combustion liner cap assembly comprising:

a combustor having a combustor casing and a combustion liner within said combustor casing and closed at a forward end by the combustion liner cap assembly, said combustion liner cap assembly comprising a radially inner substantially cylindrical component;

a radially outer substantially conical component attached to a forward end of said combustor casing and extending substantially along an entire length dimension of said radially inner component; and an annular airflow passage therebetween; wherein said annular airflow passage increases in cross sectional area in a flow direction of air to the combustor that is opposite a flow direction of combustion gases in the combustor; and further comprising a plate supporting a plurality of premix burner tubes radially inward of said radially inner cylindrical component.

6. The combustor and combustion liner cap assembly of claim 5 wherein said radially inner component and said radially outer component are separated by a plurality of circumferentially spaced webs.

7. The combustor and combustion liner cap assembly of claim 5 including a radial flange on the radially outer substantially conical component, adapted to be located between forward and aft turbine combustor casing components.

8. A method of reducing pressure loss across a combustion liner cap assembly located at a forward end of a gas turbine combustor, the cap assembly supporting a plurality of premix tubes adapted to receive portions of a like number of nozzles, and wherein air flows in a first direction in an annular passage radially outwardly of the combustor where it reverses to flow in a second, opposite direction through the premix tubes, the method comprising adding a diffuser to the forward end of the cap assembly, said diffuser configured to increase the cross sectional area of said annular flow passage along an axial length of the cap assembly in said first direction to thereby cause a reduction in velocity of the air in said annular flow passage and thereby reduce pressure loss as the air reverses to said second direction at a forward end of the combustor.

* * * * *